US005542895A

United States Patent [19]

Colbo, Jr.

[11] Patent Number: 5,542,895

[45] Date of Patent: Aug. 6, 1996

[54] MOVABLE WEIGHT STACK DEVICE AND SUPPORT FRAME FOR MULTI-STATION WEIGHT-TRAINING MACHINE

[76] Inventor: Kenneth G. Colbo, Jr., 929 SW. Higgins, #6, Missoula, Mont. 59803

[21] Appl. No.: 419,411

[22] Filed: Apr. 10, 1995

[51] Int. Cl.[6] ..... A63B 21/062

[52] U.S. Cl. ..... 482/98; 482/93; 482/94; 482/99; 482/138

[58] Field of Search ..... 482/92–94, 97–103, 482/133, 138, 908, 148

[56] References Cited

U.S. PATENT DOCUMENTS

| | | | |
|---|---|---|---|
| 3,290,044 | 12/1966 | Krodsen et al. | 482/94 |
| 4,624,457 | 11/1986 | Silberman et al. | 482/98 |
| 4,634,118 | 1/1987 | Jensen | 482/133 |
| 4,795,149 | 1/1989 | Pearson | 482/133 |
| 4,951,943 | 8/1990 | Farenholtz | 482/99 |

FOREIGN PATENT DOCUMENTS

| | | | |
|---|---|---|---|
| 1140902 | 8/1957 | France | 482/102 |

*Primary Examiner*—Richard J. Apley
*Assistant Examiner*—Victor K. Hwang
*Attorney, Agent, or Firm*—John R. Flanagan

[57] ABSTRACT

A multi-station weight-training machine includes a movable weight stack device and support frame. The device includes a plurality of weights in stack form, an upright support structure mounting the weights for undergoing vertical movement between upper and lower ends of the upright support structure and a movable carriage for mounting the upright support structure and the weights therewith to undergo lateral movement along and to positions at different workout stations disposed along the support frame of the multi-station weight-training machine. The support frame includes an upright framework supporting the different workout stations and lower and upper structures attached to the upright framework for supporting therebetween the movable weight stack device and for guiding it to undergo lateral movement between opposite ends of the upright framework and along and to different positions adjacent to the different workout stations. By this arrangement, the movable weight stack device is freely movable between the different workout stations.

19 Claims, 3 Drawing Sheets

MOVABLE WEIGHT STACK DEVICE AND SUPPORT FRAME FOR MULTI-STATION WEIGHT-TRAINING MACHINE

BACKGROUND OF THE INVENTION

1. Field of the Invention

The present invention generally relates to machines for weight-training and, more particularly, is concerned with a movable weight stack device and support frame for a multi-station weight-training machine.

2. Description of the Prior Art

Weight-training began as an activity largely for athletes and body builders, but has become increasingly popular among the general public at health clubs and in homes. Weights are now used to tone and develop muscles throughout the body. Machines have been developed which utilize weights to exercise just about every part of the human body. These weight-training machines normally use a stack of weights in their operation so that the amount of weight can be varied by each user of a machine. For locations such as health clubs which often have limited space, multi-station weight-training machines have been developed so as to accommodate many different machines for the exercise of various parts of the human body.

Many multi-station weight machines, however, use more than one selectorized weight stack to accommodate each station. This use of more than one weight stack often causes multi-station machines to have more parts and to be greater in size, and thus less portable, more expensive, more dangerous to place in poorly-supported areas and more likely to show excessive wear on stack rods because the stacks may not be perfectly aligned.

Some existing multi-station machines do utilize only one weight stack, but these machines are not efficient in that they entail the use of complicated pulley and cable systems, which often result in crossing over of cables, display less efficiency in lifting the weights of a stack and are more likely to show excessive wear on the cables, stacks and pulleys due to the use of non-direct lifting angles.

Consequently, a need remains for a multi-station weight-training machine which utilizes only one weight stack that is freely movable between different workout stations and does not cause excessive wear on component parts.

SUMMARY OF THE INVENTION

The present invention provides a multi-station weight-training machine having a movable weight stack device and support frame which are designed to satisfy the aforementioned need. The device and support frame each individually constitute features of the present invention. The principal advantage of the machine is that the weight stack device is freely movable between different workout stations.

Accordingly, the present invention is directed to a movable weight stack device, which basically comprises: (a) a plurality of weights in stack form; (b) an upright support structure mounting the weights for undergoing vertical movement between upper and lower ends of the upright support structure; and (c) movable means for mounting the upright support structure and the weights therewith to undergo lateral movement between different workout stations of the multi-station weight-training machine.

More particularly, the upright support structure has a lower base, an upper base and a pair of parallel vertical support rods extending between and connected to the lower and upper bases and being for receiving and guiding the plurality of weights in stack form between the lower and upper bases. A pair of parallel vertical support members are attached to and extend above the upper base. The movable means has a plurality of lower wheels mounted to the lower base and an upper wheel attached to and supported between the upper ends of the support members directly above the top of the upper base.

The present invention is further directed toward a support frame, which basically comprises: (a) an upright framework defining a plurality of workout stations; and (b) lower and upper structures for receiving and supporting the movable weight stack device therebetween and for guiding the device to undergo lateral movement between the workout stations.

More particularly, the upright framework is an arrangement of interconnected bars for supporting the lower and upper structures. The lower structure has a pair of lower tracks extending relatively in parallel relation to one another between and attached at each end to a lower portion of the upright framework. The upper structure has an upper track extending between and relatively in perpendicular relation to the pair of parallel vertical support members and extending between and attached at each end to an upper portion of the upright framework. The pair of lower tracks of the lower structure are relatively in parallel relation to and arranged below on either side of the upper track of the upper structure, thereby providing for the free movement of the wheels of the movable means in either direction upon the lower and upper tracks.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
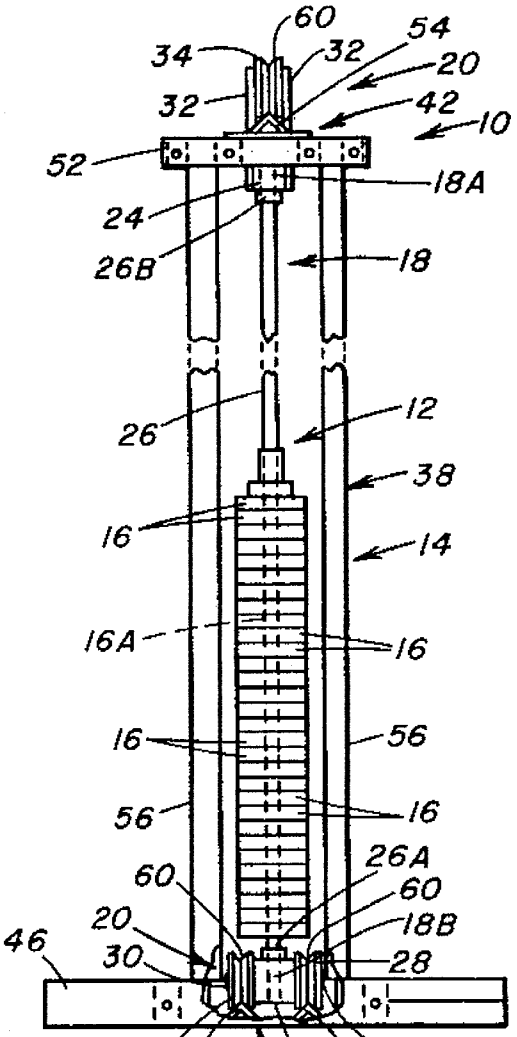
FIG. 2 is an end elevational view of the multi-station weight-training machine.
Figure 1:
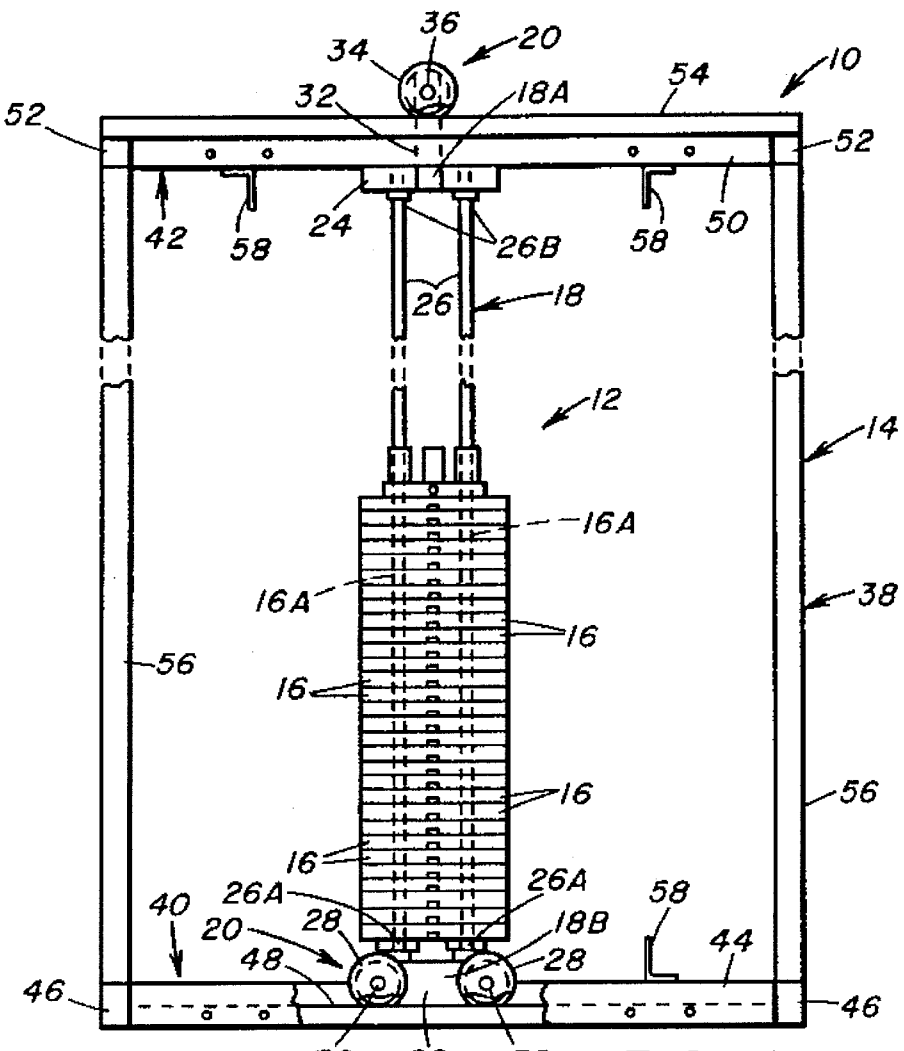
FIG. 1 is a side elevational view of the multi-station weight-training machine of the present invention.
Figure 3:
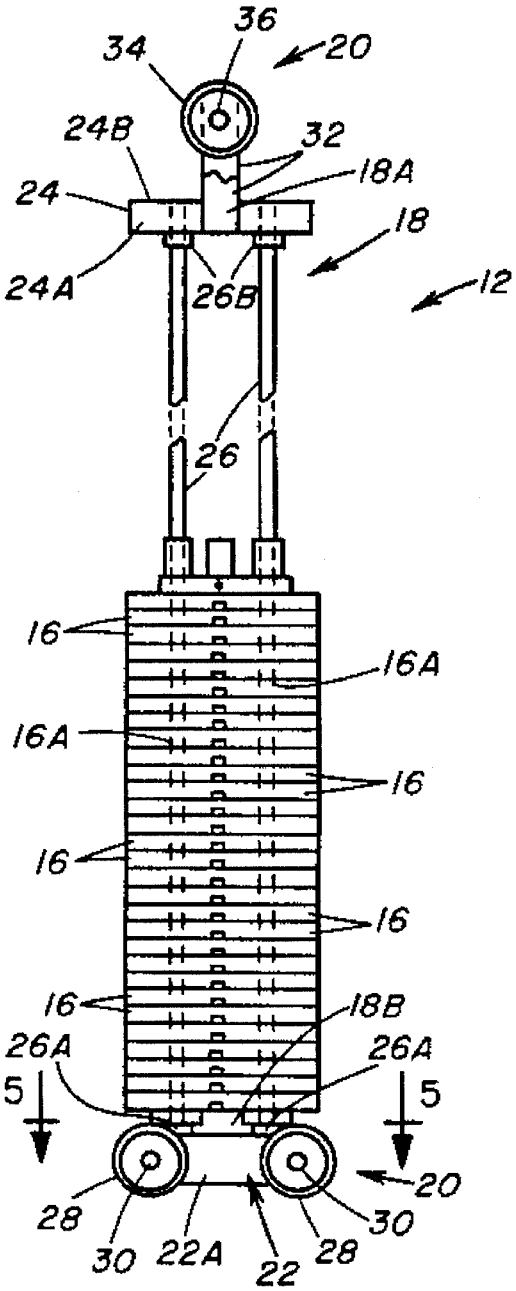
FIG. 3 is a side elevational view of the movable weight stack device of the present invention.
Figure 4:
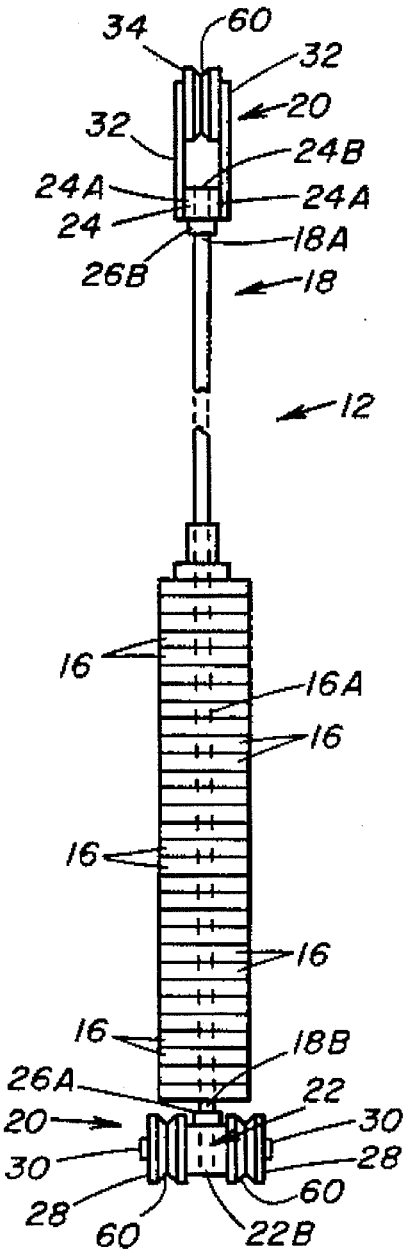
FIG. 4 is an end elevational view of the movable weight stack device.
Figure 5:
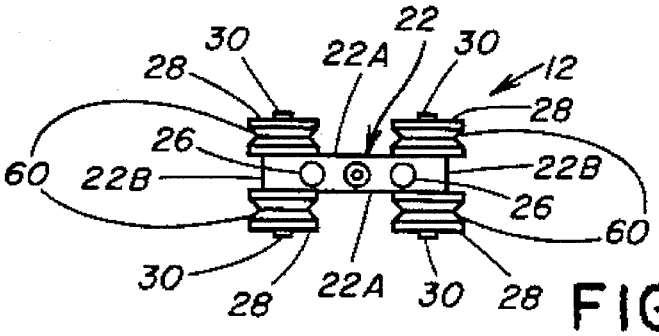
FIG. 5 is a top plan view of a plurality of lower wheels of the movable carriage means of the movable weight stack device as seen along line 5—5 of FIG. 3.
Figure 6:
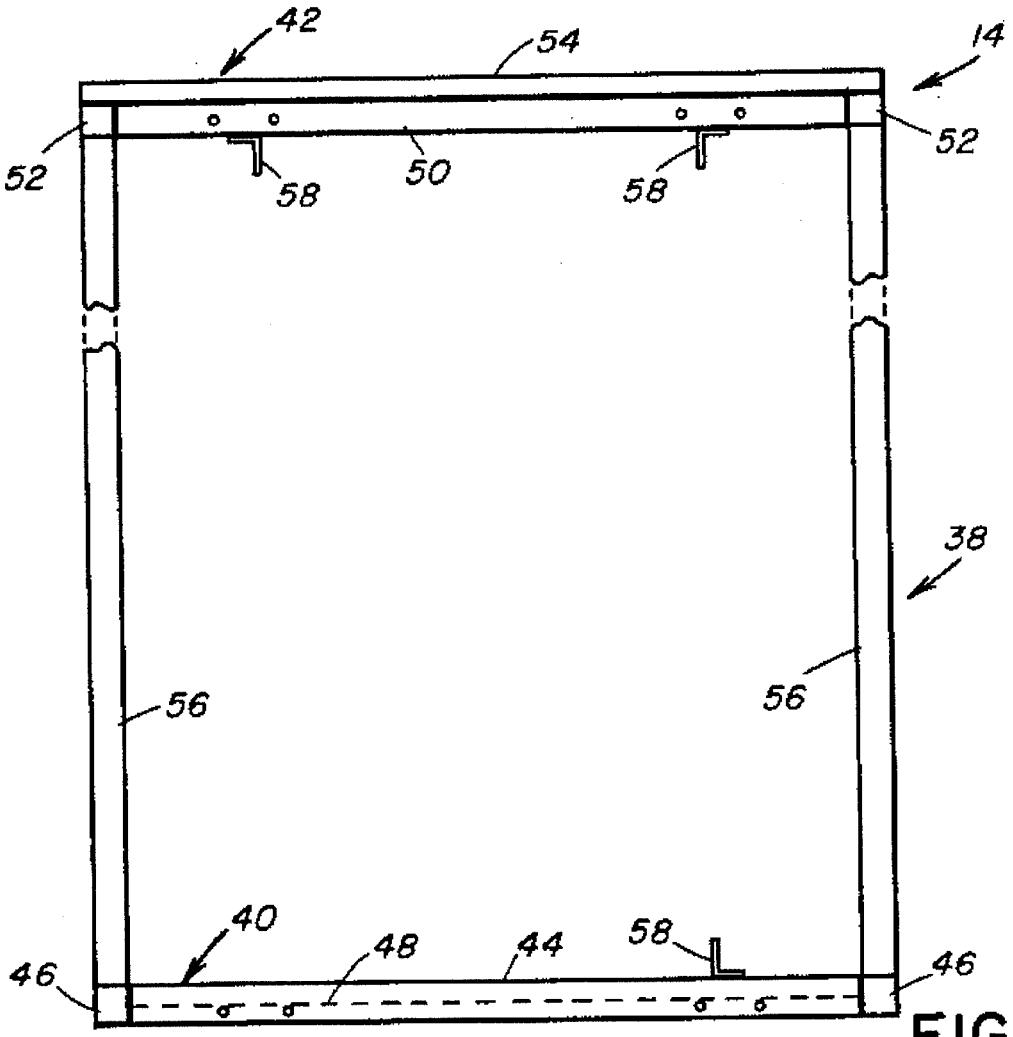
FIG. 6 is a side elevational view of the multi-station support frame of the present invention.
Figure 7:
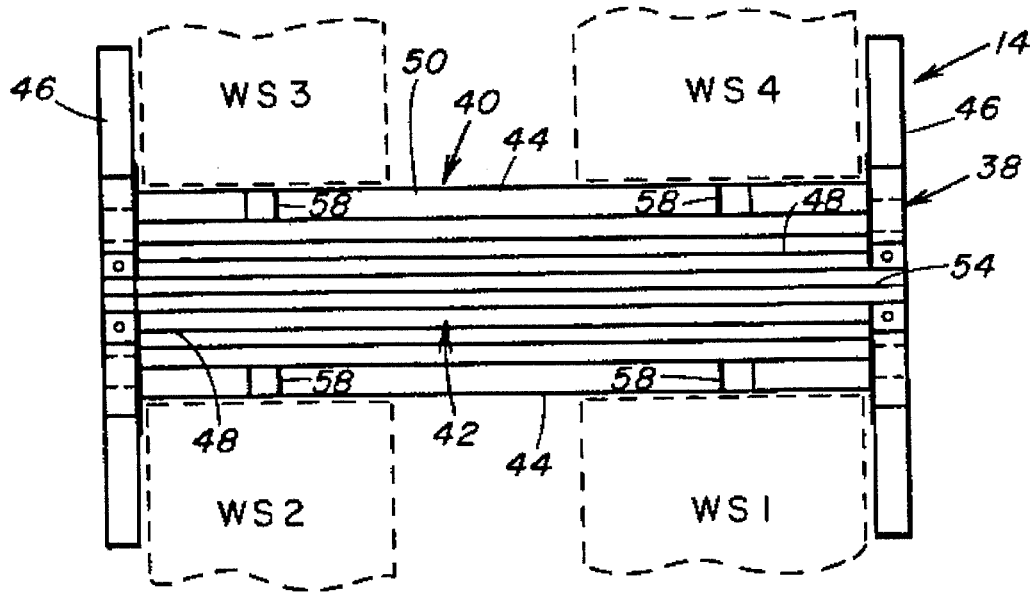
FIG. 7 is a top plan view of the support frame.

Referring to the drawings and particularly to FIGS. 1 and 2, there is illustrated a multi-station weight-training machine, generally designated 10, of the present invention. The machine 10 basically includes a movable weight stack device 12 and a support frame 14 which supports the weight stack device 12 for movement between and positioning at first, second, third and fourth workout stations WS1, WS2, WS3 and WS4 of the weight-training machine 10 (see also FIG. 7). The multiple workout stations are positioned adjacent to and supported by the support frame 14, as depicted diagrammatically in dashed line form in FIG. 7. The workout stations per se form no part of the present invention. By way of example only, the first workout station WS1 is a seated pec-dec fly station, the second workout station WS2 is a seated leg press station, the third workout station WS3 is a seated bench press & lat pull station, and the fourth workout station WS4 is a seated leg extension and low puller station. The movable weight stack device 12 and the support frame 14 of the machine 10 individually and in combination constitute the features of the present invention.

Referring now to FIGS. 1 to 5, the movable weight stack device 12 of the machine 10 basically includes a plurality of weights 16 in stack form, an upright support structure 18 and a movable carriage means 20. The upright support structure 18 mounts the weights 16 in the stack form for undergoing vertical movement between upper and lower ends 18A, 18B of the support structure 18. The movable carriage means 20 mounts the support structure 18 and the weights 16 therewith so as to undergo lateral horizontal movement between the different workout stations WS1, WS2, WS3, WS4 of the machine 10.

The upright support structure 18 of the device 12 includes a lower base 22, an upper base 24 and a pair of vertical support rods 26. The lower and upper bases 22, 24 of the structure 8 are preferably in the form of rectangular blocks made of any suitable material, such as steel or aluminum. The vertical support rods 26 of the structure 18, preferably in the form of a pair of rigid cylindrical tubes made of a suitable material such as steel or aluminum, are laterally spaced apart from one another and extend in substantially parallel relation to one Another and vertically between the lower and upper bases 22, 24. The vertical support rods 26 are connected in any suitable manner at their lower ends 26A to the lower base 22 and at their upper ends 26B to the upper base 24. The weights 16 have pairs of bores 16A defined therethrough and spaced apart from one another by the same spacing as that between the support rods 26. The bores 6A have diameter sizes adapting the weights 16 to be slidably installed over the support rods 26 with the support rods 26 extending through the bores 16A. Thus, the support rods 26 slidably receive and hold the weights 16 in the vertical stacked form and movably guide the weights 16 between the lower base 22 and the upper base 24 of the device 12.

The movable carriage means 20 of the device 12 has two pairs of lower wheels 28 rotatably mounted to the lower base 22. The pairs of lower wheels 28 are rotatably mounted by lower axles 30 being attached to and extending outwardly from opposite sides 22A of the lower base 22 and disposed adjacent to each of a pair of opposite ends 22B of the lower base 22. The movable carriage means 20 further has a pair of generally parallel vertical support members 32 respectively attached to a pair of opposite sides 24A of the upper base 24 at a middle location therealong and extending thereabove and an upper wheel 34 rotatably mounted by an upper axle 36 attached to and extending between the upper ends of the support members 32 and spaced above the top 24B of the upper base 24. The support members 32 preferably are flat rigid bars.

Referring now to FIGS. 1, 2, 6 and 7, the support frame 14 of the machine 10 basically includes an upright framework 38 for supporting the plurality of workout stations WS1, WS2, WS3, WS4 and respective lower and upper structures 40, 42 attached respectively to lower and upper portions of the upright framework 38 which receive and support therebetween the movable weight stack device 12. The lower and upper structures 40, 42 also guide lateral movement therealong of the weight stack device 12 between opposite ends of the upright framework 38 and to positions adjacent to the workout stations WS1, WS2, WS3, WS4.

The upright framework 38 of the support frame 14 at the lower portion thereof includes a pair of elongated lower horizontal cross bars 44 which extend in generally parallel relation to one another and a pair of elongated lower horizontal end bars 46 which extend in generally parallel relation to one another. The lower horizontal end bars 46 are fixedly connected to and extend in substantially perpendicular relation to opposite ends of the lower horizontal cross bars 44. The lower structure 40 of the support frame 14 includes a pair of elongated rigid lower tracks 48 extending in substantially parallel relation to one another between and attached at opposite ends to the lower horizontal end bars 46 of the lower portion of the upright framework 38.

The upright framework 38 of the support frame 14 at the upper portion thereof includes a pair of elongated upper horizontal cross bars 50 which extend in generally parallel relation to one another and a pair of elongated upper horizontal end bars 52 which extend in generally parallel relation to one another. The upper horizontal end bars 52 are fixedly connected to and extend in substantially perpendicular relation to the upper horizontal cross bars 50. The upper structure 42 of the support frame 14 includes an elongated rigid upper track 54 extending between and attached at opposite ends to the upper horizontal end bars 52 of the upper portion of the upright framework 38.

The upright framework 38 at each of the opposite ends thereof also includes a pair of elongated vertical end bars 56 extending in generally parallel relation to one another and in substantially perpendicular relation to the lower and upper horizontal end bars 46, 52 of the lower and upper portions of the upright framework 38. The vertical end bars 56 are fixedly connected at their respective upper and lower ends with the lower and upper horizontal end bars 46, 52. Also, a plurality of brackets 58 are connected to and extend upwardly from each of the lower horizontal cross bars 44 and downwardly from each of the upper horizontal cross bars 50 for attachment of components of the respective workout stations WS1, WS2, WS3, WS4 thereto.

The lower and upper horizontal cross and end bars 44, 46 and 50, 52 and vertical end bars 56 are rigid and preferably rectangular in shape, with each bar having a respective length being substantially greater than its width. Also, the cross bars 44, 50 have substantially greater lengths than the end bars 46, 52. The vertical end bars 56 have a relatively greater length than the cross bars 44, 50. Further, the lower horizontal end bars 46 have relatively greater lengths than that of the upper horizontal end bars 52 so as to thereby provide for stability of the support frame 14 as it rests in the upright position on a support surface.

The pair of lower tracks 48 of the lower structure 40 are disposed in a generally parallel relation to and arranged below and on opposite side of the upper track 54 of the upper structure 42 thereby providing for the free movement of the lower and upper wheels 28, 34 of the movable carriage means 20 in either direction upon the lower and upper tracks 48, 54. Further, the lower and upper wheels 38, 34 have peripheral grooves 60 formed centrally therein which are V-shaped in cross-section with inner sides of the grooves 60 defining a first acute angle. The lower and upper tracks 48, 54 are formed by angled rails with downwardly diverging outer sides forming a second acute angle being substantially equal to the first acute angle of the grooves 60 of the lower and upper wheels 28, 34. Thus, the first acute angle of the wheel grooves 60 and the second acute angle of the tracks 48, 54 are matched to one another so as to provide for the free movement of the movable carriage means 20 in either direction between the opposite ends of the support frame 14 upon the lower and upper tracks 48, 54 thereby providing for the free movement of the stack of weights 16 between the positions adjacent to the workout stations WS1, WS2, WS3, WS4. This arrangement enables the weights 16 in stack form to have a self-centering effect relative to a lifting force imposed generally by a pulley and cable system (not shown) upon the weights 16. This effect results in providing direct lifting angles so as to prevent excessive wear to the weights 16 and to the support rods 26 of the upright support structure 18 of the movable weight stack device 12.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A movable weight stack device for a multi-station weight-training machine, said device comprising:

(a) a plurality of weights in stack form;

(b) an upright support structure mounting said weights for undergoing vertical movement between upper and lower ends of said upright support structure, said upright support structure including (i) a lower base, (ii) an upper base, and (iii) a pair of parallel vertical support rods connected at lower and upper ends respectively to said lower and upper bases, said support rods receiving said plurality of weights in said stack form and guiding movement of said weights between said lower and upper bases; and (c) movable means for mounting said upright support structure and said weights therewith to undergo lateral movement between different workout stations of a multi-station weight-training machine, said movable means including a pair of generally parallel vertical support members attached to a pair of opposite sides of said upper base at a middle location therealong, said support members extending above said upper base.

2. The device of claim 1 wherein said movable means includes a plurality of lower wheels rotatably mounted to said lower base.

3. The device of claim 2 wherein said plurality of lower wheels are rotatably attached to a pair of opposite sides of said lower base adjacent to each of a pair of opposite ends of said lower base.

4. The device of claim 1 wherein said movable means also includes an upper wheel rotatably attached to and supported between upper ends of said pair of vertical support members and spaced above said upper base.

5. The device of claim 4 wherein said movable means further includes a plurality of lower wheels rotatably mounted to said lower base.

6. The device of claim 5 wherein said plurality of lower wheels are attached to a pair of opposite sides of said lower base adjacent to each of a pair of opposite ends of said lower base.

7. A multi-station weight-training machine, comprising:

(a) a movable weight stack device including (i) a plurality of weights in stack form, (ii) an upright support structure mounting said weights for undergoing vertical movement between upper and lower ends of said upright support structure, and (iii) movable means for mounting said upright support structure and said weights therewith to undergo lateral movement between different workout stations of a multi-station weight-training machine; and (b) a support frame including (i) an upright framework having a pair of opposite ends and a pair of lower and upper portions, said upright framework for supporting a plurality of workout stations having portions located generally between said opposite ends and said lower and upper portions thereof, and (ii) lower and upper structures attached respectively to said lower and upper portions of said upright framework for supporting therebetween said movable weight stack device and for guiding said movable weight stack device to undergo lateral movement between said opposite ends of said upright framework and along said lower and upper portions thereof to positions adjacent to each of the workout stations.

8. The machine of claim 7 wherein said upright support structure of said movable weight stack device includes:

a lower base;

an upper base; and a pair of parallel vertical support rods connected at lower and upper ends respectively to said lower and upper bases, said support rods receiving said plurality of weights in said stack form and guiding movement of said weights between said lower and upper bases.

9. The machine of claim 8 wherein said movable means of said movable weight stack device includes a plurality of lower wheels rotatably mounted to said to a pair of opposite sides of said lower base adjacent to each of a pair of opposite ends of said lower base.

10. The machine of claim 9 wherein said movable means of said movable weight stack device also includes:

a pair of generally parallel vertical support members attached to a pair of opposite sides of said upper base at a middle location therealong, said support members extending above said upper base; and an upper wheel rotatably attached to and supported between upper ends of said pair of vertical support members and spaced above said upper base.

11. The machine of claim 10 wherein said lower portion of said upright framework includes:

a pair of elongated lower horizontal cross bars extending in substantially parallel relation to one another; and a pair of elongated lower horizontal end bars extending in substantially parallel relation to one another, said lower horizontal end bars being connected to and extending in substantially perpendicular relation to said lower horizontal cross bars.

12. The machine of claim 11 wherein said lower structure includes a pair of elongated lower tracks extending in substantially parallel relation to one another between and attached at opposite ends to said lower horizontal end bars of said lower portion of said upright framework.

13. The machine of claim 12 wherein said upper portion of said upright framework includes:

a pair of elongated upper horizontal cross bars extending in substantially parallel relation to one another; and a pair of elongated upper horizontal end bars extending in substantially parallel relation to one another, said upper horizontal end bars being connected to and extending in substantially perpendicular relation to said upper horizontal cross bars.

14. The machine of claim 13 wherein said upper structure includes an elongated upper track extending between and attached at opposite ends to said upper horizontal end bars of said upper portion of said upright framework.

15. The machine of claim 14 wherein each of said opposite ends of said upright framework includes a pair of elongated vertical side bars extending in substantially parallel relation to one another and in substantially perpendicular relation to said lower and upper horizontal end bars of said lower and upper portions of said upright framework and being connected therewith.

16. The machine of claim 7 wherein said movable means of said movable weight stack device includes:

spaced first and second pairs of lower wheels rotatably mounted at said lower end of said upright support structure of said movable weight stack device; and at least one upper wheel rotatably mounted at said upper end of said upright support structure of said movable weight stack device and aligned between said pairs of lower wheels.

17. The machine of claim 16 wherein said lower structure of said support frame includes:

a pair of lower tracks extending in substantially parallel relation to one another between and attached at opposite ends to a lower portion of said upright framework of said support frame, said first and second pairs of lower wheels being movably supported thereon; and an upper track extending between and attached at opposite ends to an upper portion of said upright framework of said support frame, said upper wheel being movably supported thereon, said pair of lower tracks of said lower structure being disposed in substantially parallel relation to and arranged below and on either side of said upper track of said upper structure so as to thereby provide for the free movement of said wheels of said movable means in either direction upon said lower and upper tracks and between said opposite ends of said upright framework of said support frame.

18. The machine of claim 17 wherein said lower and upper wheels have peripheral grooves formed therein which are V-shaped in cross-section with inner sides of said grooves defining a first angle.

19. The machine of claim 18 wherein said lower and upper tracks have angled rails with downwardly diverging outer sides forming a second angle being substantially equal to said first angle of said grooves of said lower and upper wheels.

* * * * *